US007084819B2

(12) United States Patent
De La Torre Barreiro et al.

(10) Patent No.: US 7,084,819 B2
(45) Date of Patent: Aug. 1, 2006

(54) PASSIVE REFLECTOR FOR A MOBILE COMMUNICATION DEVICE

(76) Inventors: José Luis De La Torre Barreiro, Urb. El Mirador del Romero, c/ El Aguila, 15 parcela A-44, 28210, Valdemorillo Madrid (ES); Francisco Lorenzo Esteban Azpiroz, Estebanez Calderon 57°. F 28020, Madrid (ES)

( * ) Notice: Subject to any disclaimer, the term of this patent is extended or adjusted under 35 U.S.C. 154(b) by 0 days.

(21) Appl. No.: 10/503,480

(22) PCT Filed: Sep. 24, 2003

(86) PCT No.: PCT/ES03/00478

§ 371 (c)(1),
(2), (4) Date: Aug. 4, 2004

(87) PCT Pub. No.: WO2004/057700

PCT Pub. Date: Jul. 8, 2004

(65) Prior Publication Data

US 2005/0088345 A1 Apr. 28, 2005

(30) Foreign Application Priority Data

Dec. 19, 2002 (ES) ..... 200202922
Jun. 18, 2003 (ES) ..... 200301420

(51) Int. Cl.
*H01Q 1/24* (2006.01)

(52) U.S. Cl. ..... 343/702; 343/718

(58) Field of Classification Search ..... 343/700 MS, 343/702, 718, 833, 834, 912
See application file for complete search history.

(56) References Cited

U.S. PATENT DOCUMENTS

| | | | | |
|---|---|---|---|---|
| 5,767,809 | A * | 6/1998 | Chuang et al. | 343/700 MS |
| 6,061,028 | A * | 5/2000 | Sakata | 343/702 |
| 6,211,830 | B1 * | 4/2001 | Monma et al. | 343/702 |
| 6,285,327 | B1 * | 9/2001 | See | 343/702 |
| 6,469,670 | B1 * | 10/2002 | Ito | 343/702 |
| 6,556,812 | B1 * | 4/2003 | Pennanen et al. | 343/702 |
| 6,600,450 | B1 * | 7/2003 | Efanov et al. | 343/726 |
| 2002/0075189 | A1 | 6/2002 | Carillo et al. | |

OTHER PUBLICATIONS

Patent Abstracts of Japan vol. 2000, No. 16, May 8, 2001 & JP 2001 007896 A (Kimura Denshi Kogyo:KK), Jan. 12, 2001.

* cited by examiner

*Primary Examiner*—Tan Ho
(74) *Attorney, Agent, or Firm*—Birch, Stewart, Kolasch & Birch, LLP

(57) ABSTRACT

Reflector that when associated to a portable telephone allows concentrating a maximum amount of radiation, providing a directional radiation source allowing an increased signal gain, greater coverage, reduced radiation on the face of the circuit attached to the telephone and a lower incidence on the human body. The reflector is attached on the casing on the portable telephone, constructed on a fiberglass plate and comprises two faces on which are arranged a number of tracks such that the radiation between the reflector and the portable telephone antenna is adjusted. The support is conformed by the reflector itself, to which are adhered two double strips, one for attachment to the telephone and another for attachment to an ornamental strip that is provided on its outer face with an attachment area and an available area.

9 Claims, 6 Drawing Sheets

PASSIVE REFLECTOR FOR A MOBILE COMMUNICATION DEVICE

This application is a 371 of PCT/ES03/00478 filed on Sep. 24, 2003.

OBJECT OF THE INVENTION

The object of the present invention is a passive signal-capturing reflector that when installed on the casing of mobile telephones or the like improves both the transmission and reception of the signals, as well as the support on which this reflector can be incorporated, which is adhered to the mobile telephone.

The present invention of a passive reflector is characterised in that when installed on a mobile telephone or the like it allows obtaining the greatest possible gain on the required bandwidth.

The present invention is also characterised by allowing an exceptional gain on a large bandwidth, allowing communication from locations where signal limitations prevent a good coverage, or from moving vehicles in difficult conditions.

Also the object of the present invention is the support on which the passive reflector comprised of a number of adhesive layers and attachment means using Velcro or the like.

Thus, the present invention lies in the field of mobile telephony and more specifically in the field of antennae for mobile telephones.

BACKGROUND OF THE INVENTION

Currently, the frequency bands used for GSM telephone transmission in Europe and America are the following:

900 MHz band (GSM 900 Europe). Encompasses from 880 MHz to 960 MHz, so that the bandwidth from 880 MHz to 914 MHz is used for transmission by the mobile station and the band from 925 MHz to 960 MHz is used for transmission by the base station.

1800 MHz band (GSM 1800 Europe). Encompasses from 1710 MHz to 1880 MHz, so that the bandwidth from 1710 MHz to 1785. MHz is used for transmission by the mobile station and the band from 1805 MHz to 1880 MHz is used for transmission by the base station.

1900 MHz band (GSM 1900 USA). Encompasses from 1850 MHz to 2005 MHz, so that the bandwidth from 1850 MHz to 1910 MHz is used for transmission by the mobile station and the band from 1945 MHz to 2005 MHz is used for transmission by the base station.

In addition, the two main design characteristics for any portable telephone antenna are that it must be mounted within the casing of the portable telephone and that during its operation the set will be handled by a user, who will point it in any direction. As the antenna is placed very near the casing, the antenna current is induced not only in the antenna but also in the conducting part of the casing, so that the original radiation pattern is changed. It is also the case that the efficiency of transmission degrades with the proximity of the human body, as the antenna is affected by the movements of the body. These design requirements are further complicated by having to manufacture the sets as small as possible. It is well known that the efficiency of radiation and bandwidth are degraded with a decreasing antenna size. On top of all of these requirements, considerations such as bandwidth security and diversity of reception must be considered.

Various solutions have been adopted to improve the gain of transmissions affected by the casing, the human body or the location. One of these is described in EP patent 661824, which describes a folding portable telephone in which the antenna is placed in the part that is rotated outwards, so that during transmission it is separated as much as possible from the user's ear in order to reduce as much as possible the gain resulting from the proximity of the human body.

Another solution is that proposed in U.S. patent 2002013159, which describes a folding portable telephone in which the antenna is on the fixed part, so that when the folding part is brought to the user's ear the antenna is separated by a certain angle from the user's head, reducing the loss of gain of the signal due to the proximity of the body.

All of these solutions have in common that they seek to reduce the effect on the transmission gain on the proximity of the human body, yet do not mention improving the signal when it is weak or in a multiroute transmission environment.

Thus, the object of this invention is to improve as much as possible the effective gain in the desired frequency range, allowing to reduce the size and weight of portable telephones while increasing the operation time, allowing using said telephones in areas of low signal intensity and allowing to reduce the transmission power, which allows reducing the battery and thus the weight of the portable telephone, or extending the operation time of the battery.

DESCRIPTION OF THE INVENTION

The invention of a passive signal-capturing reflector consists of a capturer with an exceptional gain in a large bandwidth, allowing multiroute communication or communication from vehicles in difficult situations or where coverage is poor: It provides a directional radiation beam towards the antenna of the portable telephone, allowing to concentrate as much radiation as possible and thereby increasing the gain.

This reflector allows improving the coverage, improving the gain, an easier operation of the set by the user as it can be pointed in any direction, and also allows reducing the radiation on the face adjoining the portable telephone and thus its incidence on the human body.

The reflector is disposed attached to the rear part of the portable telephone casing and does not require any additional installation. It provides a directional radiation beam on the antenna, increasing the total gain.

Said reflector is constructed on a gold-plated fibreglass plate protected by a thin insulating film, forming an impact-resistant and weather-resistant assembly.

The design of said reflector allows adjusting its impedance and that of the telephone antenna, and comprises a careful track design with the accurate measurements of a percentage of the wavelength at the working frequency.

The distance between the reflector and the telephone wavelength is 0.15 λ. This distance between the elements is what gives the capturer an optimal gain, as otherwise the fields would interact with each other, reducing the gain.

The reflector comprises two faces with similar configurations. One of the faces is directly attached to the telephone, while the other is left on the outside. Visible on each face are:

A small triangle used to adjust the reflector with the dipole, which is the telephone antenna.

Two U-shaped tracks in which each wing measures ¼ of the working frequency wavelength, and the minimum distance between lines is ⅛ of the wavelength.

An assembly of 10 coils intended for a vertical collinear adaptation. The length of the coils is adjusted in thickness to obtain a minimum SWR in the final result.

A C-shaped track allowing which by changing its thickness allows approximating a multiple of the wavelength.

In addition to this assembly it is possible to dispose on the exposed face of the passive reflector Alga-as type luminescent diodes that illuminate with a very low current. These diodes are connected by a metallic drill to the coil of the face attached to the telephone. One of the diodes acts as a rectifier to convert the induced alternating current into direct current, thereby ionising the gas in the other two diodes.

In addition, the passive signal-capturing reflector is disposed inside a support or assembly consisting of two adhesive layers, one for each face of the passive reflector, the one adjoining the portable telephone being covered by a protective plastic sheet that is removed at the time of use to adhere it to the portable telephone. One of the faces of the other adhesive layer is attached to the passive signal-capturing reflector, while on the other side it is adhered to a thicker vinyl layer that on one of its halves externally incorporates a Velcro, while the rest of it is left free to incorporate an anagram or any text, such as the user's number.

Another possibility is using the above-described support in combination with a simple structural support complementary of the previous one, which lacks any reflector, having only one double adhesive layer, one of the faces of the single adhesive layer being glued to the support on which the portable telephone is to be supported, while on its other face it is attached to the layer or to the complementary Velcro of the Velcro placed on the support adhered to the portable telephone.

DESCRIPTION OF THE DRAWINGS

As a complement of the description that follows and in order to aid a better understanding of the characteristics of the invention, the present descriptive memory is accompanied by a set of drawings whose figures, for purposes of illustration and in a non-limiting sense, shows the more representative details of the invention.

PREFERRED EMBODIMENT OF THE INVENTION

In view of the aforementioned figures, a description is made of a preferred embodiment of the invention, as well as an explanation of the drawings.

Figure 1:
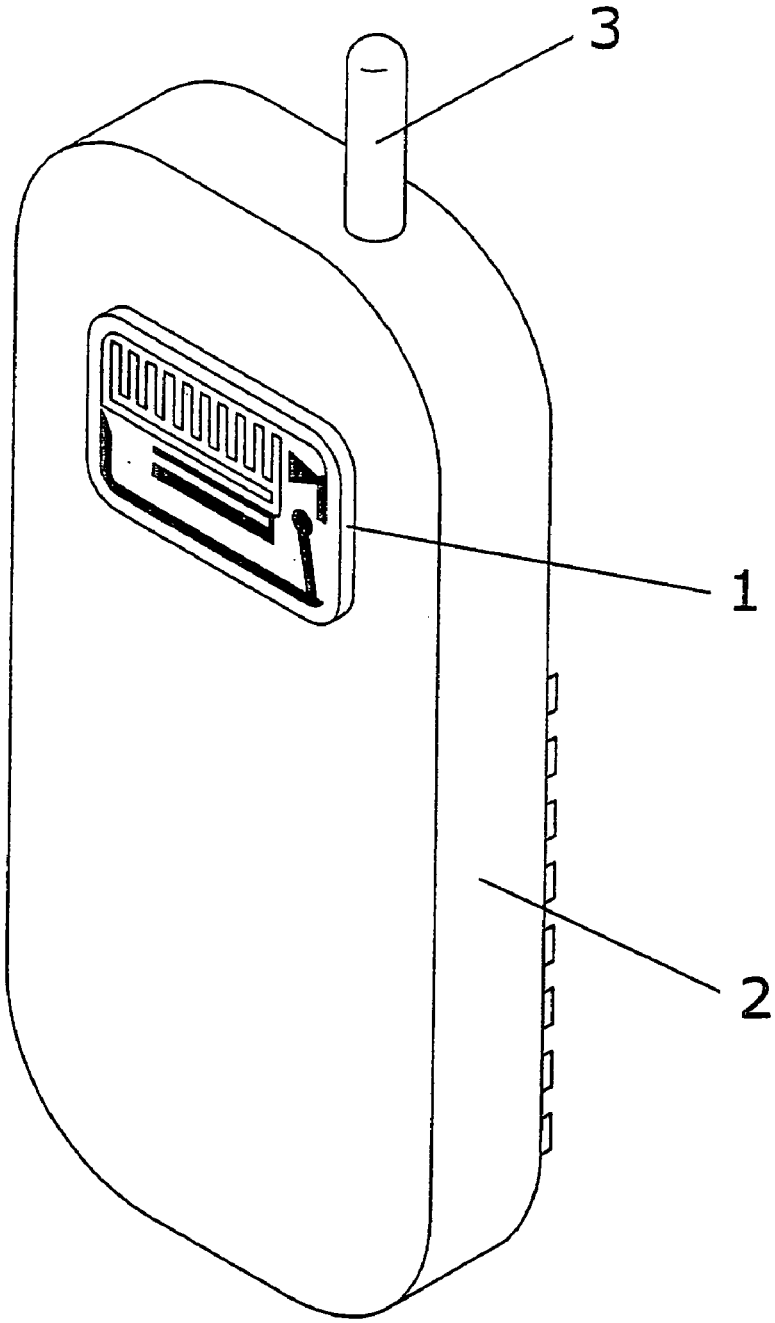
FIG. 1 shows a perspective view of a portable telephone from the rear, showing the passive reflector attached to the telephone.

FIG. 1 shows a portable telephone (2) on which is disposed a passive reflector (1). The purpose of the reflector is to increase the transmission gain for both reception and emission, thereby facilitating multiroute communication in difficult situations or where coverage is poor, as well as preventing the interference caused by the proximity of the human body. Said passive reflector (1) improves the signal transmitted by the antenna (3) of the portable telephone (2), thereby saving transmission power and allowing to reduce the size of the batteries and thus the weight of the devices or to extend their operation time.

Figure 3:
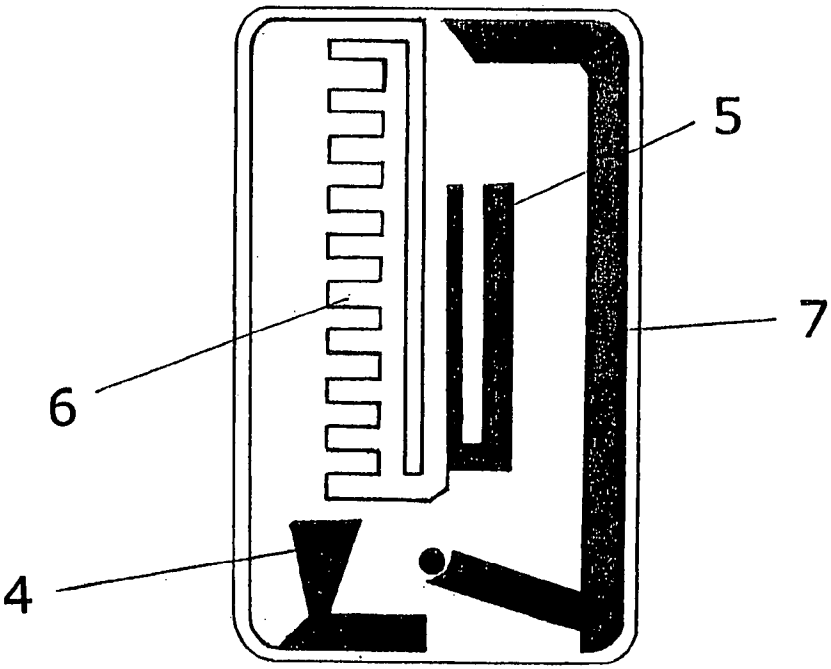
FIG. 3 shows the design of the tracks on the face on the outside.
Figure 2:
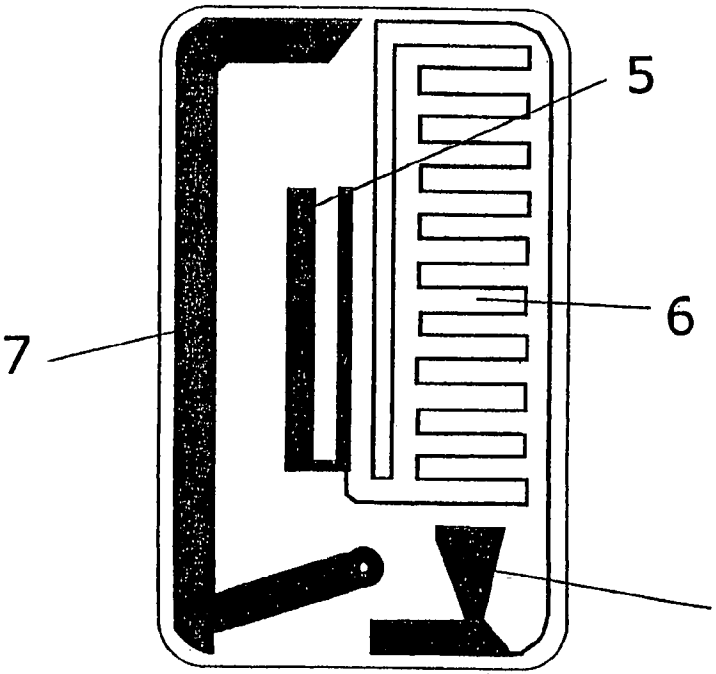
FIG. 2 shows the design of the tracks on the face attached to the telephone.

FIGS. 2 and 3 shows the face that is attached to the telephone casing and the face on the outside, respectively. A number of tracks are disposed on them carefully designed such that the impedances between the reflector and the telephone antenna are adjusted.

In each of the faces one can see:

A small triangle (4) used to adjust the reflector with the dipole, which is the telephone antenna.

Two U-shaped tracks (5) in which each wing measures $^{114}$ of the working frequency wavelength, and the minimum distance between lines is ⅛ of the wavelength.

An assembly of 10 coils (6) intended for a vertical collinear adaptation. The length of the coils is adjusted in thickness to obtain a minimum SWR in the final result.

A C-shaped track (7) allowing which by changing its thickness allows approximating a multiple of the wavelength.

Figure 4:
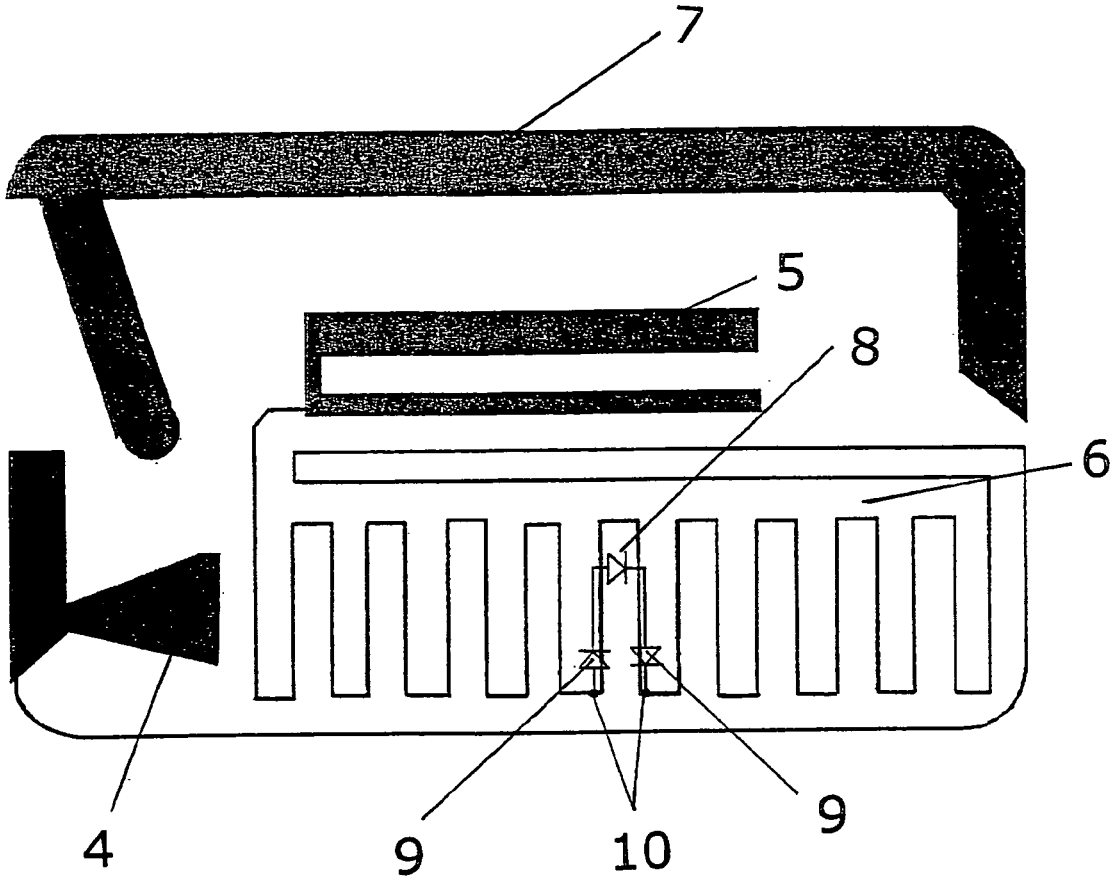
FIG. 4 shows the passive reflector on the face attached to the telephone, with luminescent diodes connected to it.

FIG. 4 shows the rear face of the passive reflector that is attached to the telephone, on which are connected diodes (8) and (9), which are disposed on the outer side of the passive reflector (1) and are connected to the coils (6) with a metallic drill (10).

The diodes (9) are Alga-as diodes that illuminate with a very low current. The diode (8) is a rectifier diode that converts the alternating current induced in the coils into a direct current, ionising the gas contained in the diodes (9), which thus light up when the passive reflector is operating correctly.

The purpose of the diodes disposed in the passive reflector (1) is:

To indicate that the passive reflector is performing its function of amplifying the signal emitted and received To verify that it is properly installed in the telephone And to convert part of the radiation into light, so that the user is exposed to less radiation.

The reflector is constructed on a gold-plated fibreglass plate protected by a thin insulating film, providing an assembly with a suitable resistance.

Figures 5, 6:
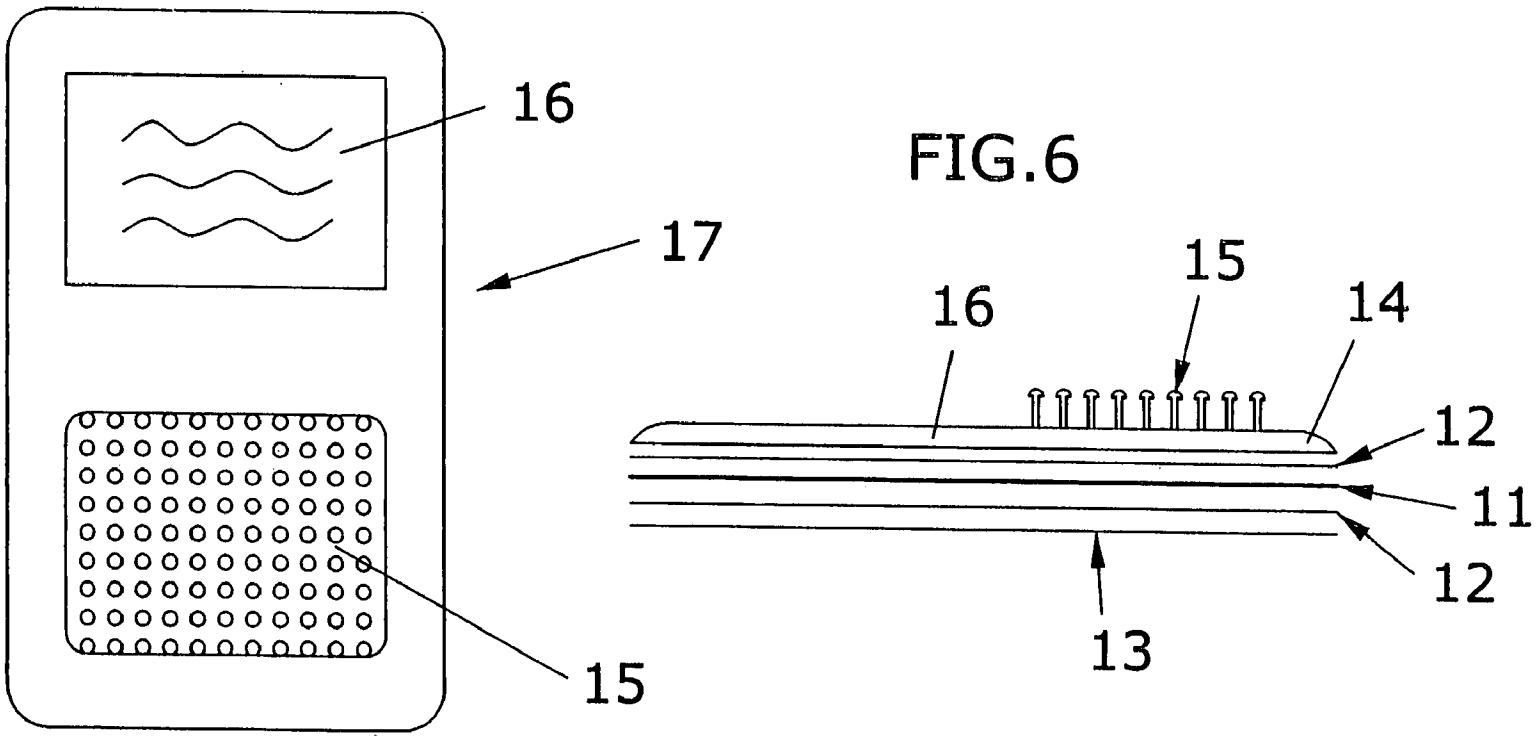
FIGS. 5 and 6 show a front elevation and sectional view of the support with the passive signal-capturing reflector.

FIGS. 5 and 6 show a support that as well as allowing housing inside it the passive signal-capturing reflector (11) allows attaching it to the portable telephone on one side and to any support with complementary means of those provided in the support (17).

The support assembly consists of the reflector (11), with corresponding double adhesive layers (12) on either side of it, the layer that is attached to the portable telephone being covered by a protective layer (13) that is removed when adhering the layer. The other adhesive strip (12) is joined on one side to the reflector (11) and on the other side to a thicker strip (14) made of vinyl, metal, noble wood or any other plastic or natural material, incorporating on part of its outer face a Velcro strip (15), while on the rest of this face it has a square (16) used to support any anagram or information.

Figure 7:
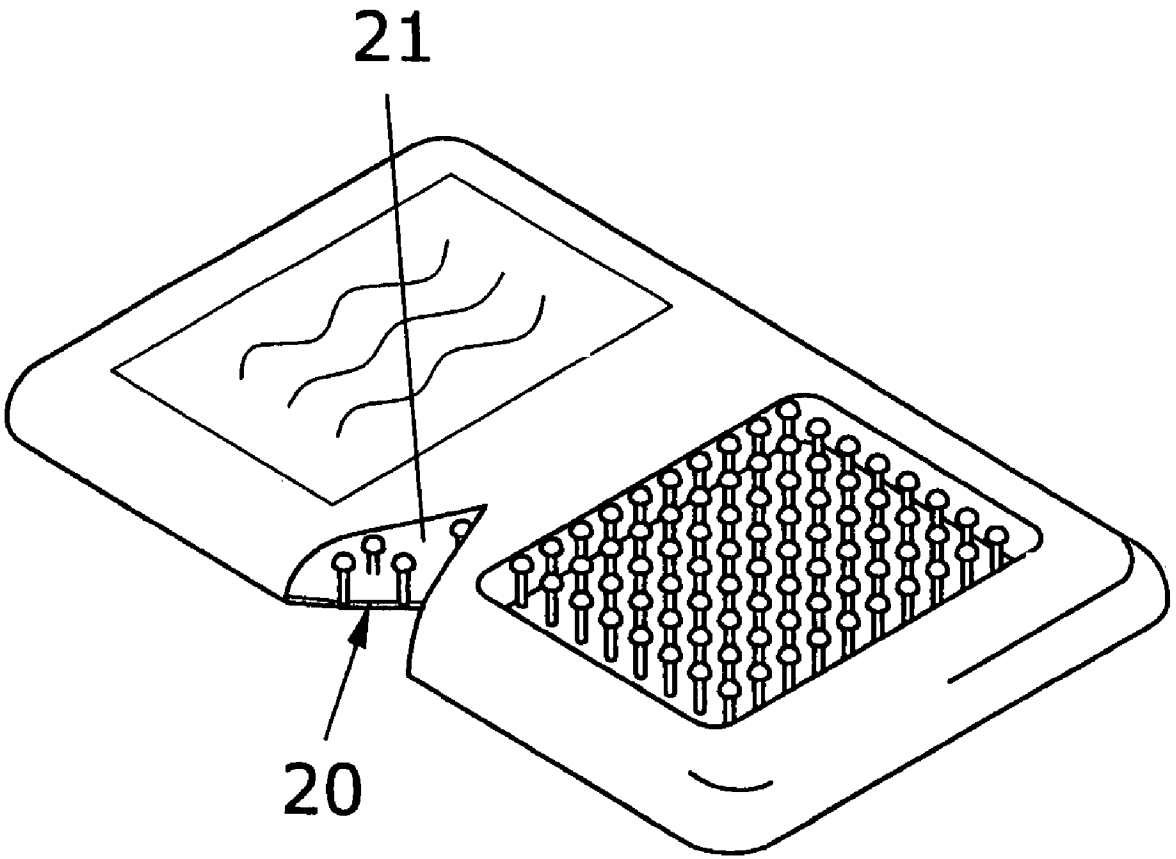
FIG. 7 shows a perspective view of the wall support of the portable telephone to any furniture item, partially sectioned in order to show the Velcro covered in resin.

FIG. 7 shows another possible embodiment of the support assembly, which does not contain the reflector (11) inside it and in which the thick strip (14) is replaced by a Velcro strip (20) receiving a resin (21) in the area of the square (16), the rest of the face being uncovered for attachment purposes.

Figure 8:
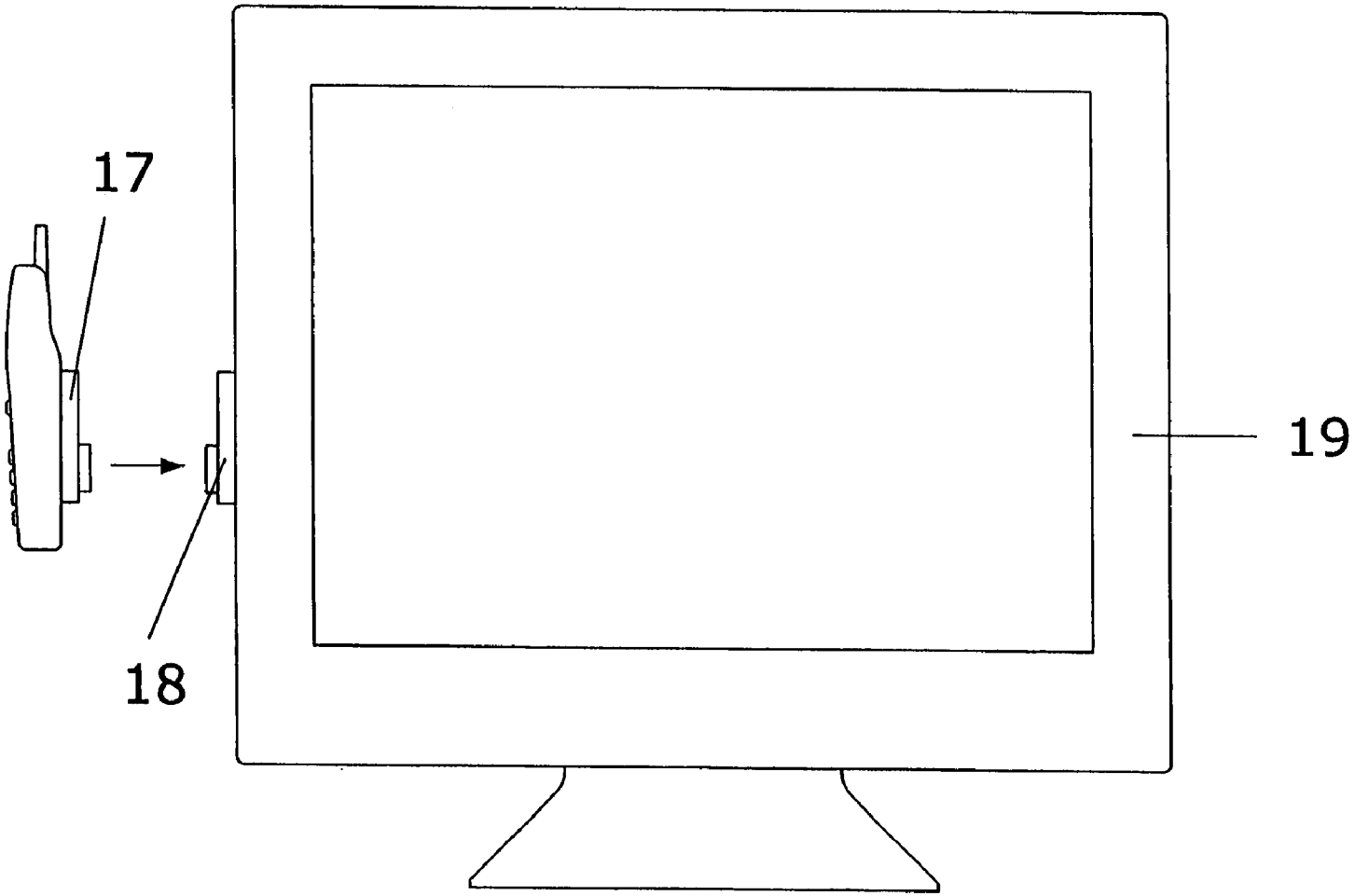
FIG. 8 shows the wall support applied to a personal computer.

FIG. 8 shows the portable telephone on which is attached the support (17), inside which is the passive reflector (11), provided on a support panel (19) with another support, complementary to the previous one, which allows attaching the portable telephone together with the support (17). This antagonistic support is not provided with a reflector (11) inside it, it has a single adhesive layer used to attach the support to the panel (19), while on its other face it is attached to the thick layer (14) on which are disposed the attachment means complementary to the Velcro strip (15).

It is not considered necessary to extend this description for an expert in the field to understand the scope of the invention and the advantages derived thereof.

The materials, shape, size and arrangement of the component elements may vary as long as the essence of the invention is not altered.

The terms used in this descriptive memory shall be understood in a wide and non-limiting sense.

The invention claimed is:

1. A passive signal-capturing reflector for increasing signal gain and coverage and for reducing loss of transmission caused by proximity of the portable telephone to a human body, the reflector wherein, the reflector has two faces, one adjoining the portable telephone and the other facing outwardly from the portable telephone, each face having a number of tracks and each face comprising:

a small triangle for adjusting the reflector with respect to the telephone antenna, two U-shaped tracks in which each wing measures ¼ of the working frequency wavelength, and the minimum distance between lines of the tracks is ⅛ of a wavelength of the portable telephone, an assembly of coils intended for a vertical collinear wherein the length of the coils is adjusted in thickness to obtain a minimum SWR, and a C-shaped track providing, by changing its thickness, approximating a multiple of the wavelength, the distance between the reflector and an antenna of the portable telephone being 0.15 times the wavelength.

2. The passive signal-capturing reflector as claimed in claim 1, wherein the coils of the outwardly facing face of the passive reflector comprises diodes, connected to said coils by metallic drills, wherein at least one diode is a diode that rectifies the alternating current into a direct current and at least one diode is a luminescent diodes with an Alga-as type internal gas.

3. The passive signal-capturing reflector of claim 1, further comprising an adhesive layer on each face thereof, one said adhesive layer comprising a protective plastic sheet that is removed for adhering said reflector to the portable telephone, and said other adhesive layer is adhered to a strip of vinyl, wood, metal or plastic material further provided on its outer face with a fastener for attachment to an external support.

4. A passive signal-capturing reflector for increasing signal gain and coverage and reducing loss of transmission caused by proximity to a human body when assembled on portable telephones the reflector comprising, a gold-plated fiberglass plate protected by a thin insulating film, an adhesive layer on each side thereof, one of said adhesive layers being adhered to the portable telephone and having a protective plastic sheet that is removed when adhering it to the portable telephone, and the other said adhesive layer is adhered to a strip of vinyl, wood, metal or plastic material further provided with a fastener for attachment to an external support.

5. A passive signal reflector for a portable telephone, said reflector comprising two faces, each said face comprising active elements for increasing in the portable telephone signal gain and coverage and reducing loss of transmission caused by proximity to a human body, and means for attaching the reflector to a part of the portable telephone body, so that radiation on the face of the portable telephone is reduced.

6. A passive signal-capturing reflector as in claim 5, wherein, when joined to the telephone, one face of the reflector faces the portable telephone and the other faces outwardly from the telephone, each face comprising, a small triangle for adjusting the reflector with respect to the telephone antenna, two U-shaped tracks in which each wing measures ¼ of the working frequency wavelength with a minimum distance between lines of the tracks of ⅛ of the wavelength of the telephone, an assembly of coils wherein the length of the coils is adjusted in thickness to obtain a minimum SWR, and a C-shaped track providing by changing its thickness, approximating a multiple of the wavelength.

7. The passive signal-capturing reflector, as claimed in claim 6, wherein the distance between the reflector and an antenna of the portable telephone is 0.15 times a wavelength of the portable telephone.

8. The passive signal reflector as claimed in claim 5, comprising a gold-plated fiberglass plate protected by a thin insulating film.

9. The passive signal-capturing reflector of claim 5 further comprising an adhesive layer for adhering said reflector to a portable telephone, and a second adhesive layer for adhering the reflector to an external support.

* * * * *